United States Patent [19]

Harding

[11] Patent Number: 4,603,651

[45] Date of Patent: Aug. 5, 1986

[54] INFLATABLE BOAT

[75] Inventor: Richard J. A. Harding, Kidwelly, Wales

[73] Assignee: Avon Inflatables Limited, Great Britain

[21] Appl. No.: 330,591

[22] Filed: Dec. 14, 1981

Related U.S. Application Data

[63] Continuation of Ser. No. 106,018, Dec. 21, 1979, abandoned.

[51] Int. Cl.[4] ..... B63B 7/08

[52] U.S. Cl. ..... 114/345

[58] Field of Search ..... 114/345, 348, 357; 441/35, 37, 40–42, 66

[56] References Cited

U.S. PATENT DOCUMENTS 3,168,751 2/1965 Cavaignac et al. ..... 114/345

FOREIGN PATENT DOCUMENTS

| | | | |
|---|---|---|---|
| 814847 | 9/1951 | Fed. Rep. of Germany | 441/40 |
| 1964657 | 7/1971 | Fed. Rep. of Germany | 114/345 |
| 2051835 | 4/1972 | Fed. Rep. of Germany | 114/345 |
| 1964507 | 9/1977 | Fed. Rep. of Germany | 114/345 |
| 576108 | 3/1946 | United Kingdom | 114/345 |
| 682100 | 11/1952 | United Kingdom | 114/345 |

*Primary Examiner*—Trygve M. Blix
*Assistant Examiner*—Stephen P. Avila
*Attorney, Agent, or Firm*—Cushman, Darby & Cushman

[57] ABSTRACT

An inflatable boat is provided with a multi-keel by having an inflatable member or members constrained to lie between the flexible skin of the boat and a reaction surface. Preferably there is a rigid deck as a reaction surface overlying the flexible skin with two parallel inflatable tubes under the deck spaced apart by a distance equal to half the width of the deck.

9 Claims, 6 Drawing Figures

Fig. 3.
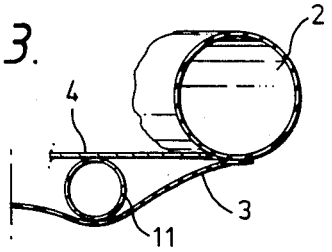
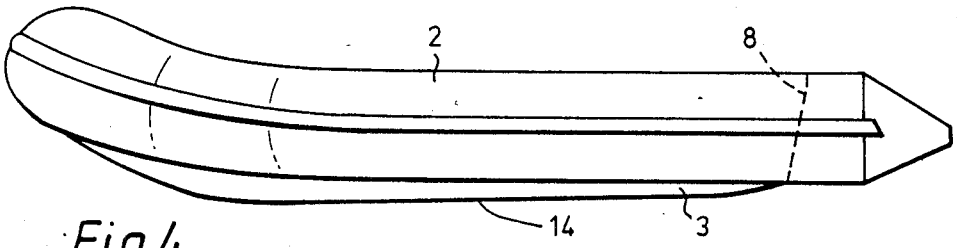
Fig. 4.
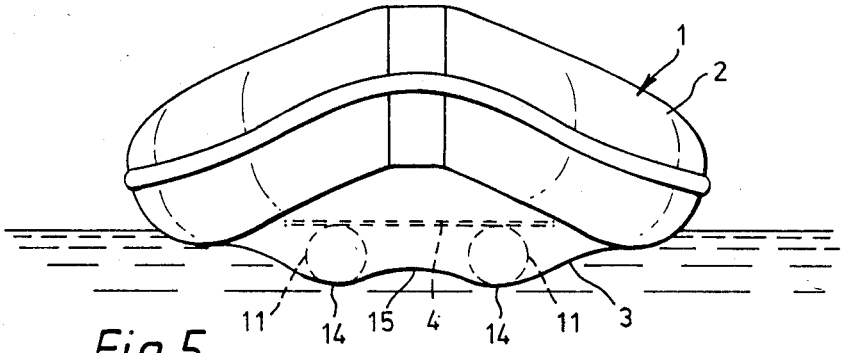
Fig. 5.
Fig. 6.
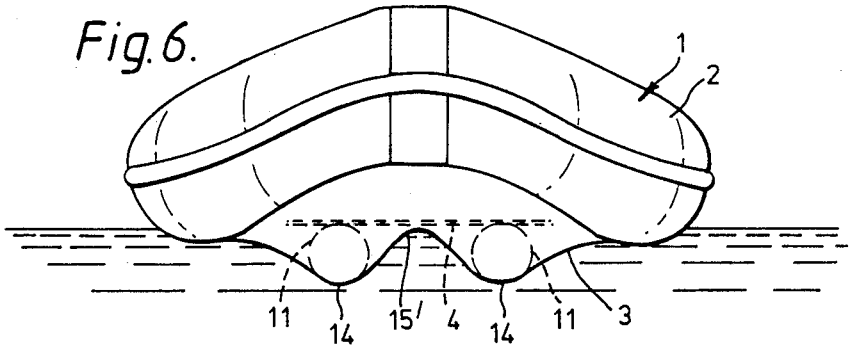

INFLATABLE BOAT

This is a continuation of application Ser. No. 106,018 filed Dec. 21, 1979, now abandoned.

FIELD OF THE INVENTION

This invention relates to inflatable boats, that is boats having inflatable flotation members, and is concerned with the keel arrangements of such boats.

BACKGROUND OF THE INVENTION

There have been numerous prior proposals relating to the underwater surface of inflatable boats, and it has also been suggested that for rigid-hull boats multi-keel underwater surfaces should be provided. Thus in British Pat. No. 1,273,692 there is disclosed a boat hull provided in a forward section with a twin keel and in a rearward section with a single keel. The forward twin keels may each be lowerable or raisable to improve riding characteristics of the hull.

In British Pat. No. 1,319,072 there is disclosed an inflatable boat in which the shape of the hull is a function of the hull construction itself of a number of inflatable tubes which cooperate to provide a generally U-shaped or V-shaped cross-section for the hull.

In British Pat. No. 1,362,677 there is disclosed an inflatable boat having inflatable side walls serving as floatation members, a flexible underwater skin, a rigid deck and between said skin and deck an inflatable former member along the longitudinal centre-line of the boat shaping the flexible skin to form a central keel.

However in none of these prior art proposals has it been appreciated or suggested that by having a boat with a flexible underwater skin and inflatable former members to cause the undersea surface of the boat to have a multi-keel construction, automatic adaptation of the planing characteristics of the boat to the load carried in the boat could be achieved.

SUMMARY OF THE INVENTION

The present invention is concerned to form, by inflation, a multi-keel underwater surface. The proposal uses the flexiblity of a fabric skin, stretched over shaped inflated formers, to allow inherently the adaptation of the shape of the underwater surface to load conditions being experienced. This gives a self-compensating underwater surface which retains its good planing performance under all load conditions. The use of parallel twin inflated formers (preferably separate sacs or tubes) to give a generally W-section underwater surface is simplest and at the same time yields very good results. The spacing apart of the parallel formers may be 50% of the deck width of the boat.

The floor will provide the reaction surface against which the formers act and will most conveniently be rigid panels extending the whole width of the boat and terminating under, and being supported by, the inflated buoyancy tubes of the boat.

Boats thus constructed may be of any appropriate size but especially suitable will be application of this invention to boats of larger sizes, e.g. 7 meters length upwards, whether with single or multiple engine installations.

DESCRIPTION OF THE DRAWINGS

A particular boat embodying the invention will now be described with reference to the accompanying drawings wherein:

FIG. 3 is a partial, diagrammatic, lateral section;

FIG. 4 is a side view and

FIGS. 5 and 6 show front views of the boat in the water in heavily and lightly loaded condition respectively.

Figure 1:
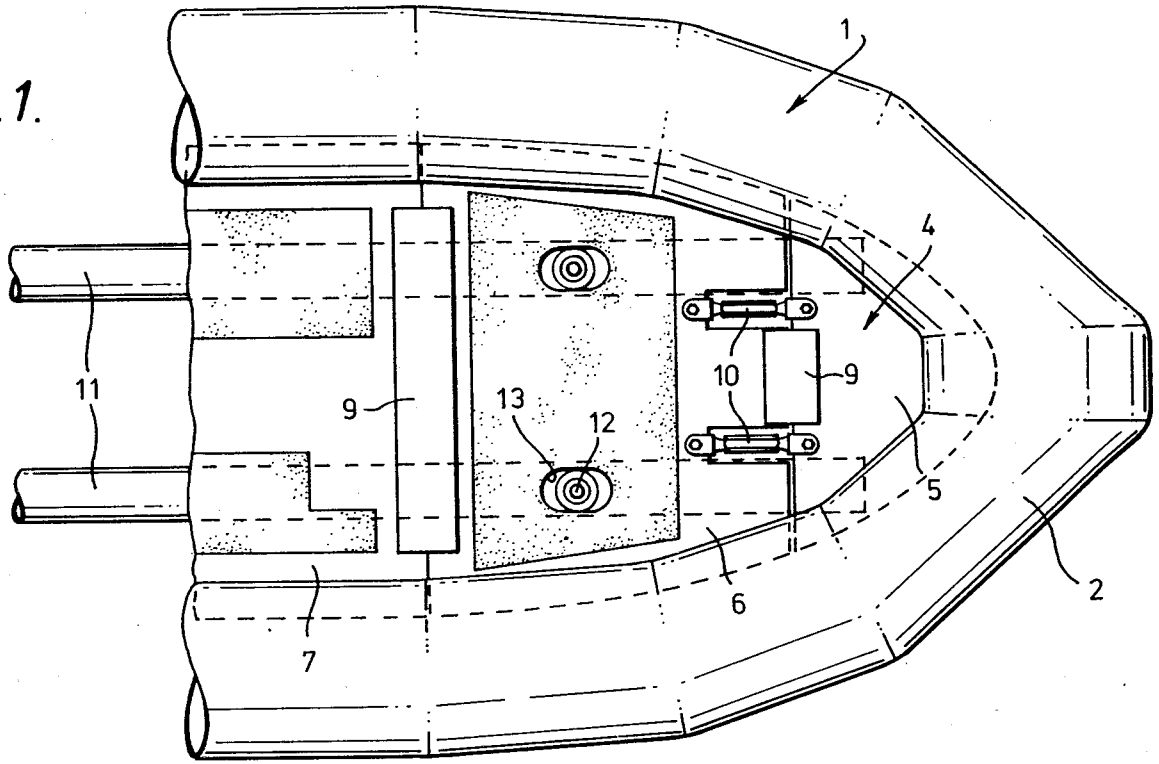
FIG. 1 is a plan view of the forward part of the boat.
Figure 2:
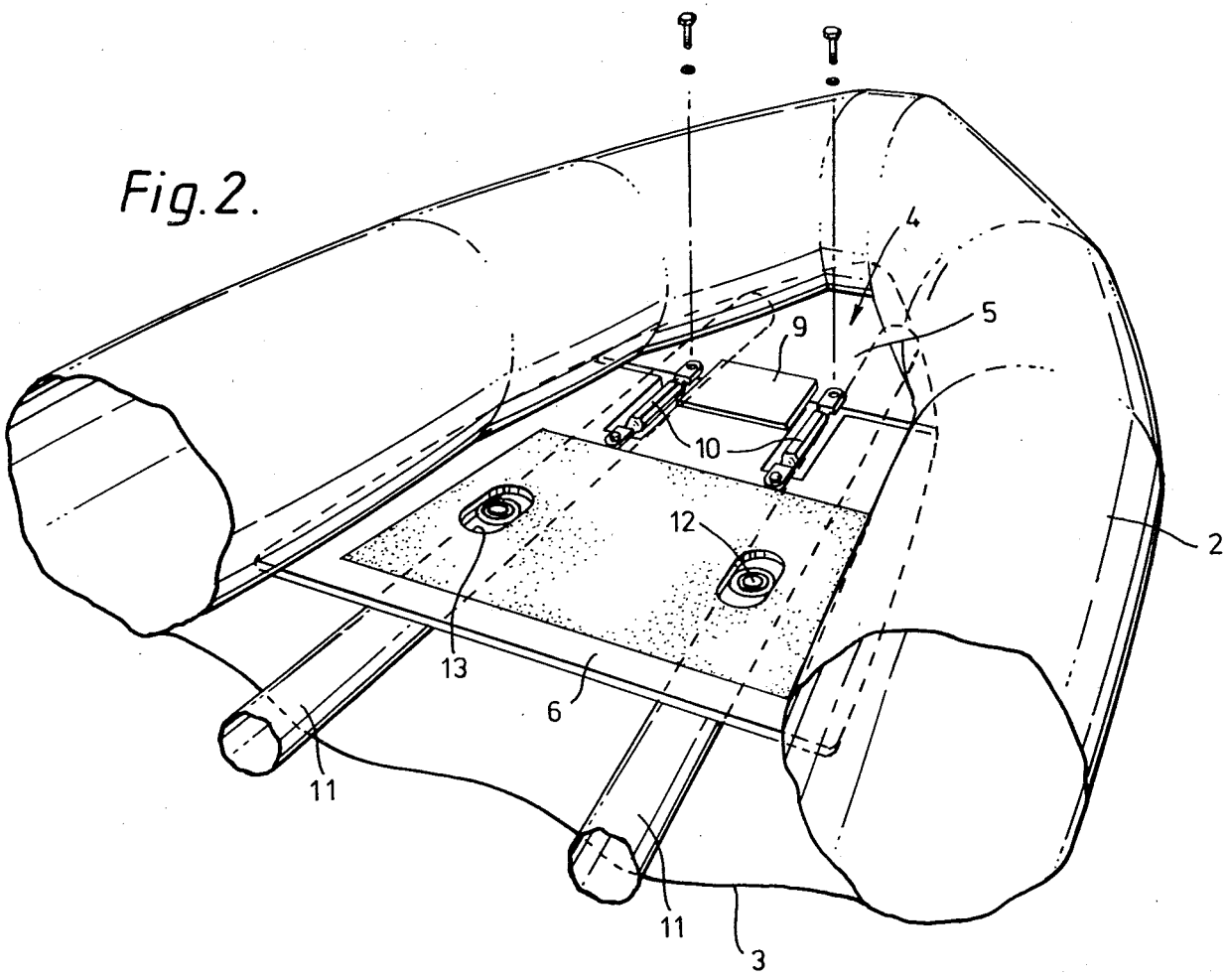
FIG. 2 is a perspective view of the forward part of the boat.

The boat 1 has the usual U-shaped inflated buoyancy tube 2 attached to a flexible fabric floor 3 and a rigid deck 4. The deck 4 is made up of at least three rigid panels extending the whole width of the boat. A forward panel 5 is adapted to the shape of the bow of the boat, a removable panel 6 allows for the assembly of the floor and for access to inflatable keel-formers, and at least one rear panel 7 extends as far as a transom 8 (FIG. 4) which closes off the after end of the boat and to which (a) power unit(s) can be attached.

The panel 6 has plates 9 fitting over the adjacent edges of panels 5 and 7 and has expansion braces 10 boltable to panel 5 and then expansible to tighten the floor in the boat. The edges of the panels are trapped under the overhang of the inflated buoyancy tube 2 (FIG. 3).

Between the deck 4 and the floor 3 there are fitted two parallel inflatable tubes 11. Respective inflation valves 12 are accessible through parts 13 in the panel 6. The tubes 11 are spaced apart by about 50% of the width of the deck 4.

When the buoyancy tube 2 and the keel-formers 11 are inflated the deck 4 provides a reaction surface from which the tubes 11 act to press the floor 3 downwardly to form a W or catamaran section with twin keels 14 separated by a channel 15, 15'. The panels of the deck 4 are supported by the overhang of the buoyancy tube 2.

As can be seen in FIGS. 5 and 6 the inherent characteristic of a flexible floor 3 supported by spaced inflated keel-formers is to adapt its conformation to the load being experienced. Greater load deepens the channel between the twin keels 14 (15' as against 15). This gives good planing characteristics under any load conditions, something which is difficult to admire for most flexible-bottomed inflatable boats.

What is claimed is:

1. A load carrying inflatable boat capable of carrying a plurality of passengers and capable of planing and comprising:

a flexible skin defining the bottom of the boat;

a member having a rigid reaction surface overlying the skin; and at least one inflatable member between said skin and said reaction surface to define twin inflated parallel keels engaging deepest into the water when the boat is on water, the keels being parallel to the center line of the boat and spaced from it at respective sides thereof, the skin forming a continuously water-contacting planing surface of the boat between the keels, the planing surface having a concave cross-section, the concavity of which is variable in accordance with the loading experienced on water so as to adapt the shape of the water-contacting planing surface to load conditions.

2. An inflatable boat according to claim 1, wherein the reaction surface consists of a rigid deck overlying the flexible skin.

3. An inflatable boat according to claim 1, wherein the inflatable members are two parallel tubes which on inflation give a twin-keel boat with one keel on each side of the centreline of the boat.

4. An inflatable boat according to claim 1, wherein the parallel tubes are spaced apart by a distance equal to about half the width of the reaction surface.

5. In a load carrying inflatable boat for carrying a plurality of passengers having a flexible underwater skin, a reaction surface overlying said skin and an inflatable former lying between the said skin and the said reaction surface and cooperating therewith to form a keel for the boat, the improvement consisting of having one or more inflatable formers adapted to cooperate with the said reaction surface and the said skin to form when inflated at least two spaced apart keels for the boat on respective sides of the centreline of the boat and providing between them a channel of the skin centred on the centreline of the boat and having a profile varying with the loading of the reaction surface to provide a self-compensating underwater surface for the boat which surface adapts itself to the planing characteristics required for different loads, the cross-section of the undersurfaces formed by said skin being substantially constant along the length of the keels when said members are inflated.

6. The improvement according to claim 5, wherein the reaction surface consists of a rigid deck overlying the flexible skin and cooperating directly with the former member or members.

7. The improvement according to claim 6, wherein the inflatable former member or members consist of two spaced-apart parallel tubes.

8. The improvement according to claim 7, wherein the parallel tubes are spaced apart by a distance equal to about half the width of the deck.

9. The improvement according to claim 5, wherein the rigid deck has openings providing access to the inflatable formers.

* * * * *